US010596614B2

(12) United States Patent
Sheriff

(10) Patent No.: US 10,596,614 B2
(45) Date of Patent: Mar. 24, 2020

(54) PUNCH AND DIE HOLDING APPARATUS AND METHOD

(71) Applicant: Swanstrom Tools USA Inc., Superior, WI (US)

(72) Inventor: Timothy W. Sheriff, Duluth, MN (US)

(73) Assignee: SWANSTROM TOOLS USA INC., Superior, WI (US)

( * ) Notice: Subject to any disclaimer, the term of this patent is extended or adjusted under 35 U.S.C. 154(b) by 387 days.

(21) Appl. No.: 15/497,956

(22) Filed: Apr. 26, 2017

(65) Prior Publication Data

US 2017/0320120 A1 Nov. 9, 2017

Related U.S. Application Data

(60) Provisional application No. 62/332,251, filed on May 5, 2016.

(51) Int. Cl.

| | |
|---|---|
| ***B21D 28/34*** | (2006.01) |
| ***B21D 37/04*** | (2006.01) |
| ***B30B 1/00*** | (2006.01) |
| *B21D 53/44* | (2006.01) |
| *B30B 1/18* | (2006.01) |

(52) U.S. Cl.

CPC ..... *B21D 28/34* (2013.01); *B21D 37/04* (2013.01); *B30B 1/00* (2013.01); *B21D 53/44* (2013.01); *B30B 1/18* (2013.01)

(58) Field of Classification Search

CPC ..... B21D 22/02; B21D 22/06; B21D 28/24; B21D 28/34; B21D 37/02; B21D 37/04; B21D 37/10; Y10T 279/17547

USPC ..... 72/325, 326, 327

See application file for complete search history.

(56) References Cited

U.S. PATENT DOCUMENTS

| | | | | |
|---|---|---|---|---|
| 66,436 A * | 7/1867 | Wolf | ..... | B21D 28/34 83/613 |
| 1,955,866 A * | 4/1934 | Wales | ..... | B21D 28/26 83/50 |
| 2,364,401 A * | 12/1944 | Stellin | ..... | B21D 28/34 83/690 |
| 2,387,027 A * | 10/1945 | Jackson | ..... | B21D 28/34 83/685 |

(Continued)

OTHER PUBLICATIONS

MTI Corporation. "Precision Disc Cutter with Standard 16, 19, 20 Dia. Cutting Die & 3-24mm Optional—MSK-T-10," [online], [retrieved on May 2, 2017]. Retrieved from the Internet <http://www.mtixtl.com/PrecisionDiscCutter-MSK-T-10.aspx >.

*Primary Examiner* — Adam J Eiseman
*Assistant Examiner* — Bobby Yeonjin Kim
(74) *Attorney, Agent, or Firm* — Faegre Drinker Biddle & Reath LLP

(57) ABSTRACT

A punch and die holding apparatus comprising a die block having a bottom die plate defining a die recess and forming a die clamp, a top die plate defining a guide tube cavity, the bottom die plate and top die plate defining a punch receiving gap, a die plate clamping bolt, and a plurality of gap opening stops. The punch and die holding apparatus has a punch holder having a guide tube, a collet chuck at least partially inserted within the guide tube, a collet inserted within the collet chuck, and a punch having a first end comprising a stem, a second end comprising a punch protrusion, and a central portion, the punch stem configured to be inserted into the second end of the collet; and a die received within the die recess.

24 Claims, 14 Drawing Sheets

(56) References Cited

U.S. PATENT DOCUMENTS 2,622,682 A * 12/1952 Kopczynski ..... B21D 28/34 83/686
2,699,830 A * 1/1955 Hodge ..... B21D 28/34 83/140
2,715,440 A * 8/1955 Havican ..... A41H 25/02 28/165
3,548,700 A * 12/1970 Herzog ..... B21D 28/34 83/698.91
3,549,159 A * 12/1970 Kroener ..... B25G 3/32 279/53
3,772,954 A * 11/1973 De Ruwe ..... B21D 28/34 83/588
3,871,254 A * 3/1975 Whistler, Jr. ..... B21D 28/34 83/139
4,086,837 A * 5/1978 Dyck ..... B21D 37/04 83/637
4,257,292 A * 3/1981 Faull ..... B21D 28/34 83/146
4,292,869 A * 10/1981 Wallis ..... B21D 28/34 83/137
4,375,774 A * 3/1983 Wilson ..... B21D 28/34 83/140
4,843,931 A * 7/1989 Whister ..... B21D 28/34 83/138
5,020,407 A * 6/1991 Brinlee ..... B21D 28/12 83/530
5,265,990 A * 11/1993 Kuban ..... B23B 31/02 279/133
7,249,551 B1 * 7/2007 Ray ..... B26D 5/10 30/178
8,707,841 B2 * 4/2014 Morehead ..... B21D 28/34 83/686
10,328,479 B2 * 6/2019 Thielges ..... B21D 37/14

* cited by examiner

PUNCH AND DIE HOLDING APPARATUS AND METHOD

CROSS-REFERENCE TO RELATED APPLICATION

This application claims the benefit of U.S. Provisional Application No. 62/332,251, filed May 5, 2016, which is herein incorporated by reference in its entirety.

TECHNICAL FIELD

The instant disclosure relates to devices and methods for stamping metal parts. In particular the instant disclosure relates to a device and methods to be used with a punch press for forming stamped metal parts.

BACKGROUND

There is a strong market for manufacturing and crafting tools for use by individual crafters. Interest in making handmade crafts and jewelry on an individual basis continues to grow. Individuals can buy and assemble off-the-shelf components, components made by other individual crafters, or make their own components. Increasing numbers of crafters opt to make their components or purchase them from other crafters.

Metal discs, also referred to as stampings, are a large category of jewelry components. Currently, people wanting to make their own stampings in volume have limited choices. They can buy ready-made stampings which are more expensive than making them themselves. They can purchase stamping presses and stamping dies which also turn out to be quite expensive. They can use a traditional jewelry disc cutter which is relatively low cost but is often inconvenient for high volume production. Another option is to make individual "pancake dies" to use in a hydraulic press; this is a relatively inexpensive option but not suited for high volume production of consistently sized stampings.

Traditionally, stamping dies used in presses are self-contained units consisting of a die shoe that hold a punch, die, and stripper plate. In order to change individual components, the whole unit must often be disassembled and then reassembled which takes considerable time.

Disc cutters are fairly simple devices that have a top guide plate, punch, and die. Because of their simplicity, they may contain multiple stamp designs on one unit and do not require a press to stamp out parts. Parts are stamped by placing material between the top guide plate and die. A punch is inserted into the top guide plate and struck with a hammer to push the punch through the material. Since they do not have a part stripper plate, the punch must pass completely through the material being stamped and drop out of the bottom die plate in order to advance the material for the next stamping to be punched.

SUMMARY

Disclosed herein is a punch and die holding apparatus comprising a die block including a main body having a bottom die plate defining a die recess and forming a die clamp, a top die plate defining a guide tube cavity, the bottom die plate and top die plate defining a material receiving gap, a die plate clamping bolt engaged with the bottom die plate and top die plate, and a plurality of gap opening stops engaged with the bottom die plate and top die plate. The punch and die holding apparatus may also have a punch holder, at least partially disposed within the guide tube cavity, having a guide tube forming a first cylinder having a first end, a second end, and a wall extending between the first end and second end, a collet chuck at least partially inserted within the guide tube, the collet chuck defining a second cylinder having a first end, a second end, and a wall extending between the first end and second end, and an inner diameter and an outer diameter, a collet inserted within the collet chuck, the collet forming a first end and a second end and an inner diameter and outer diameter, and a punch having a first end comprising a stem, a second end comprising a punch protrusion, and a central portion, the punch stem configured to be inserted into the second end of the collet; and a die received within the die recess.

Also disclosed herein is a punch and die holding device comprising a die base including a bottom plate secured to a top plate, the bottom plate and top plate parallel in a first plane with a gap between the bottom plate and top plate, the bottom plate and top plate each having a thickness in a direction normal to the first plane; a die received within the bottom plate thickness. The punch and die holding device may also have a guide tube hole extending through the top plate normal to the first plane, the guide tube hole in alignment with the die; a guide tube at least partially received within the guide tube hole in alignment with the die; a collet chuck having a first end and a second end, the collet chuck first end inserted within the guide tube; a resilient spring surrounding the collet chuck and located between the guide tube and the collet chuck second end; a shaft collar surrounding the collet chuck and located between the resilient spring and the second end; a shaft collar bolt extending through the shaft collar and in frictional engagement with the collet chuck; and a removable punch having a punch stem and a punch head, the removable punch configured to attach to the first end of the collet chuck with the punch head in alignment with the die.

Also disclosed herein is a method of assembling a punch and die holding apparatus comprising securing a punch die to a first base plate; securing a second base plate to the first base plate with a gap between the second base plate and the first base plate containing the punch die. The method may also include inserting a guide tube through the second base plate and aligning the guide tube with the punch die; inserting a collet having a first end and a second end into a collet chuck; securing a punch having a stem and a cutting head to a first end of the collet by inserting the punch stem into the first end of the collet; tightening the first end of the collet around the punch stem by tightening a collet closing bolt at the second end of the collet; inserting the collet chuck containing the collet and punch into the guide tube and leaving a portion of the collet chuck outside the guide tube; placing a resilient spring around the portion of the collet chuck that is outside the guide tube and advancing the resilient spring along the outside of the collet chuck until the resilient spring is above to the guide tube; placing a shaft collar around the collet chuck and above to the resilient spring; and securing the shaft collar around the collet chuck by tightening a shaft collar clamp bolt.

The current disclosure overcomes some of the deficiencies of traditional stamping dies and disc cutters. The current disclosure does not require a part stripper plate and the punch and die are quickly interchangeable with other punches and dies without having to disassemble the whole unit. The current disclosure can be used in a press or by manually striking with a hammer.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

The instant disclosure relates to punch and die holding apparatus and associated methods. Various embodiments include a punch and die holding apparatus that can quickly be removed from a punch press and exchanged for an alternative punch. Various embodiments address a quick change die that can be quickly removed and replaced individually or along with the punch. Punch and die holding apparatus and associated methods provided by the instant disclosure address production disc cutters that can be used in hydraulic mechanical, and/or arbor presses. Various punch and die holding apparatus according to the instant disclosure can be used with a variety of punches of various shapes and sizes, offering a user devices and methods for producing a wide range of stampings with reduced change-over time. For example, various punch and die holding apparatuses described herein are provided as a punch kit that includes a punch holder, a die block, and a variety of punches of varying shapes and sizes that can be quickly changed out by a user.

Figure 1:
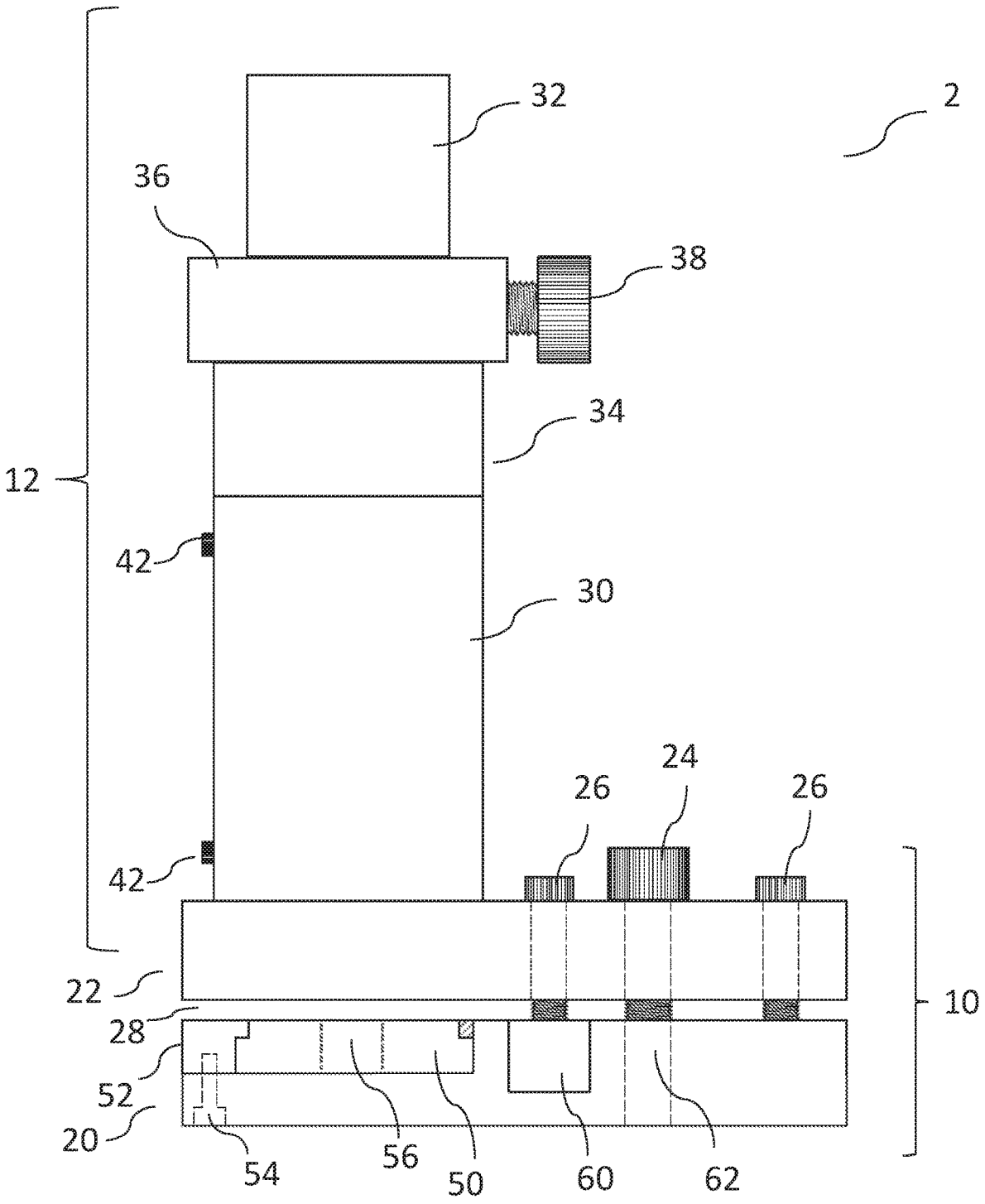
FIG. 1 is a side view of a punch and die holding apparatus, according to some embodiments.

FIG. 1 shows a punch and die holding apparatus 2 having a first section that forms a die holder 10 and a second section that forms a punch holder 12. The punch and die holding apparatus 2 can also be referred to in various embodiments as a punch and die holding apparatus, a disk cutter, a jewelry cutter, a die cutter, a hole puncher, a metal puncher, or a disk stamper as appropriate. The die block 10 includes a bottom die plate 20 and a top die plate 22, defining a die gap 28. The die block includes a die plate clamping bolt 24, gap opening stops 26, alignment pins 62, a toe clamp recess 60, a die 50, a die cavity 56, a die clamp 52, and a die clamp bolt 54. The punch holder includes a collet chuck guide tube 30, keyway bolts 42, a resilient spring 34, a shaft collar 36, a shaft collar bolt 38, and a collet chuck 32.

Figure 2:
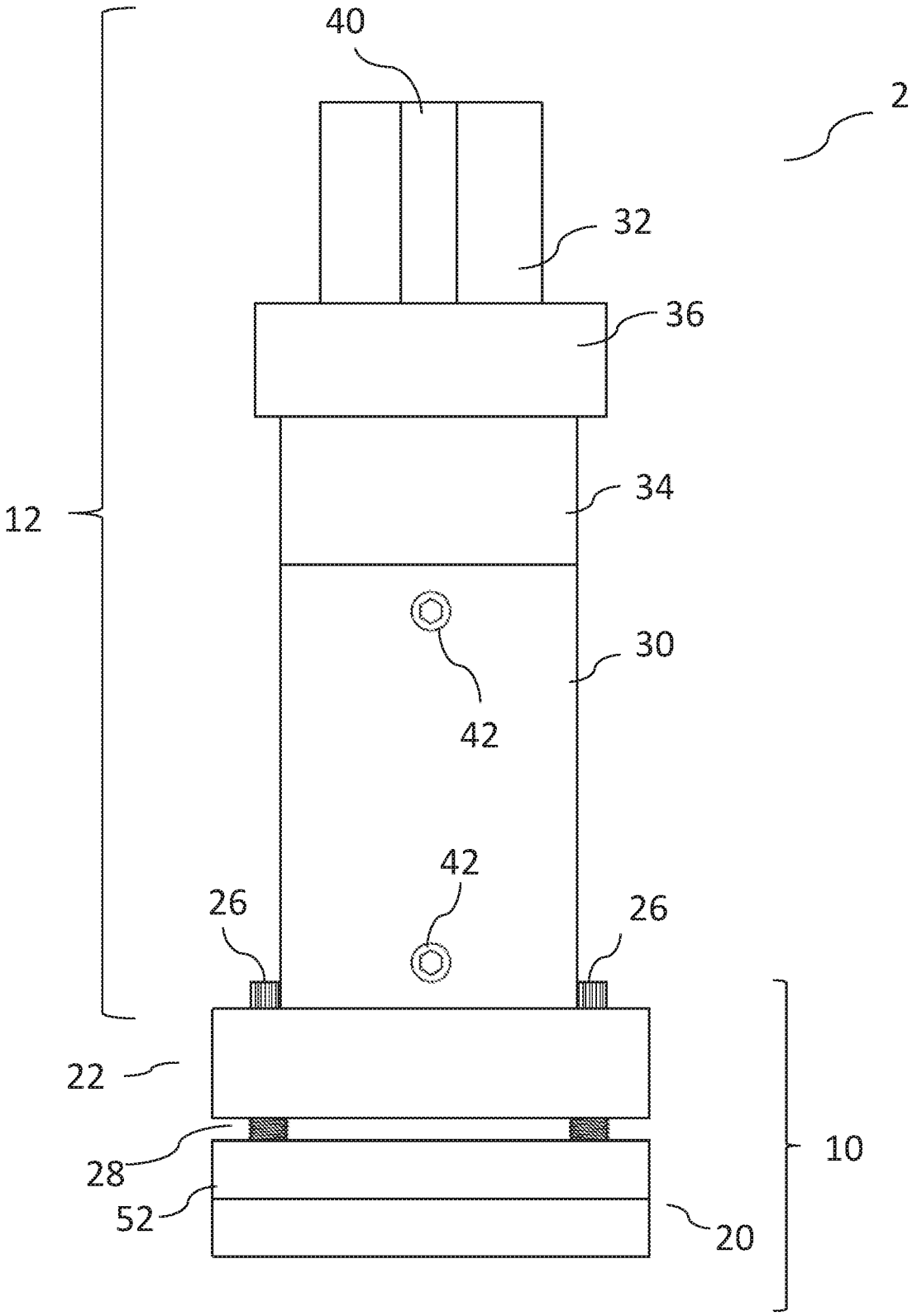
FIG. 2 is a front view of the punch and die holding apparatus of FIG. 1, according to some embodiments.

FIG. 2 contains an additional view of the punch and die holding apparatus 2. FIG. 2 contains the components shown in FIG. 1 from a front view to illustrate additional features. As shown in FIG. 2, the die block 10 is shown with the bottom die plate 20, the top die plate 22, the die gap 28, the die clamp 52, and gap opening stops 26. The punch holder 12 is shown with the collet chuck guide tube 30, keyway bolts 42, the resilient spring 34, the shaft collar 36, the collet chuck 32, and a keyway 40.

Figure 3:
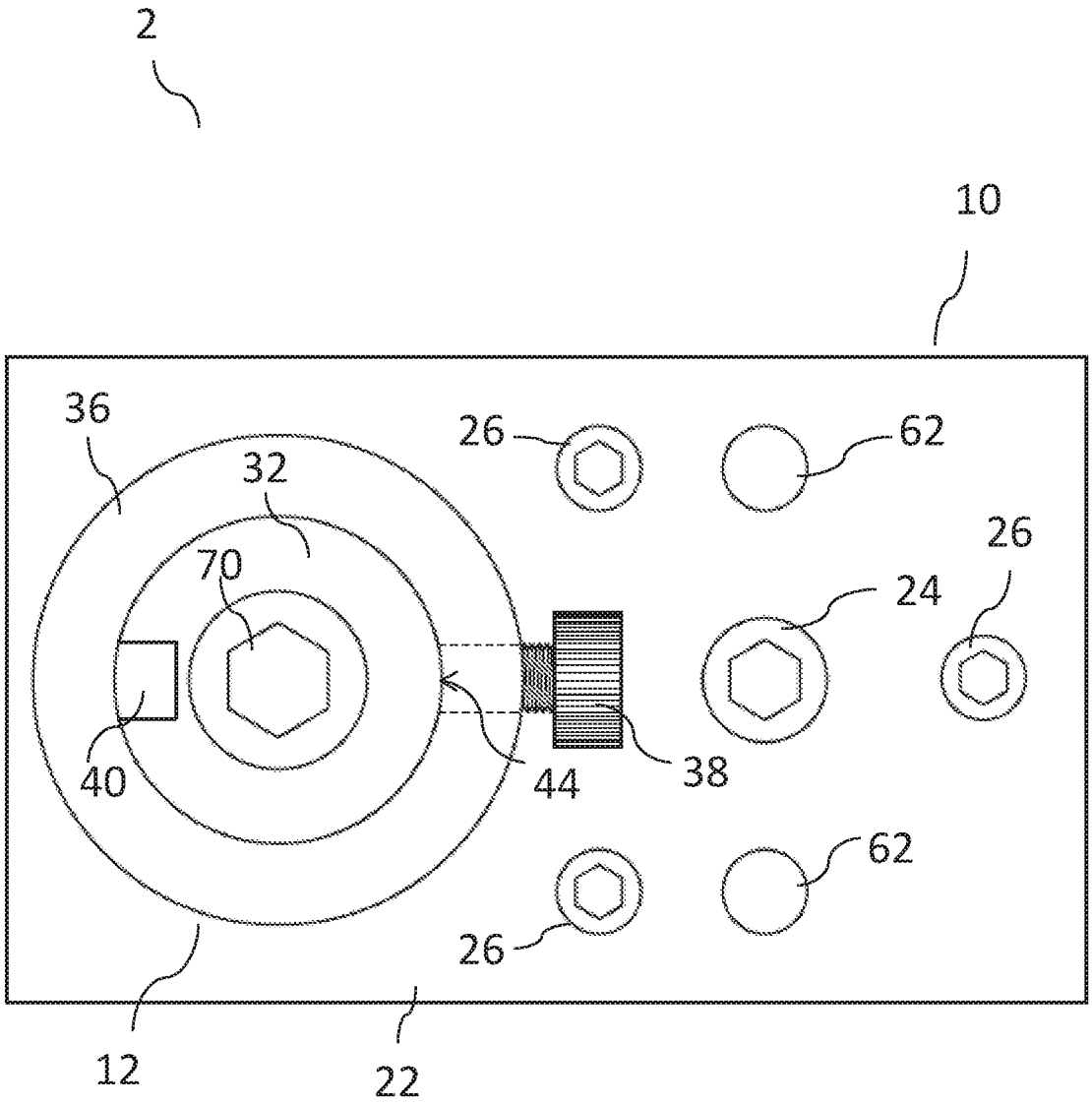
FIG. 3 is a top view of a guide tube of the punch and die holding apparatus of FIG. 1, according to some embodiments.

FIG. 3 shows the punch and die holding apparatus 2 from a top view to illustrate additional features. As shown in FIG. 3, the die block 10 is shown with the top die plate 22, the die plate clamping bolt 24, the gap opening stops 26, and the alignment pins 62. The punch holder 12 is shown with the shaft collar 36, the shaft collar bolt 38 the collet chuck 32, the keyway 40, and a collet chuck closing bolt.

Figure 3A:
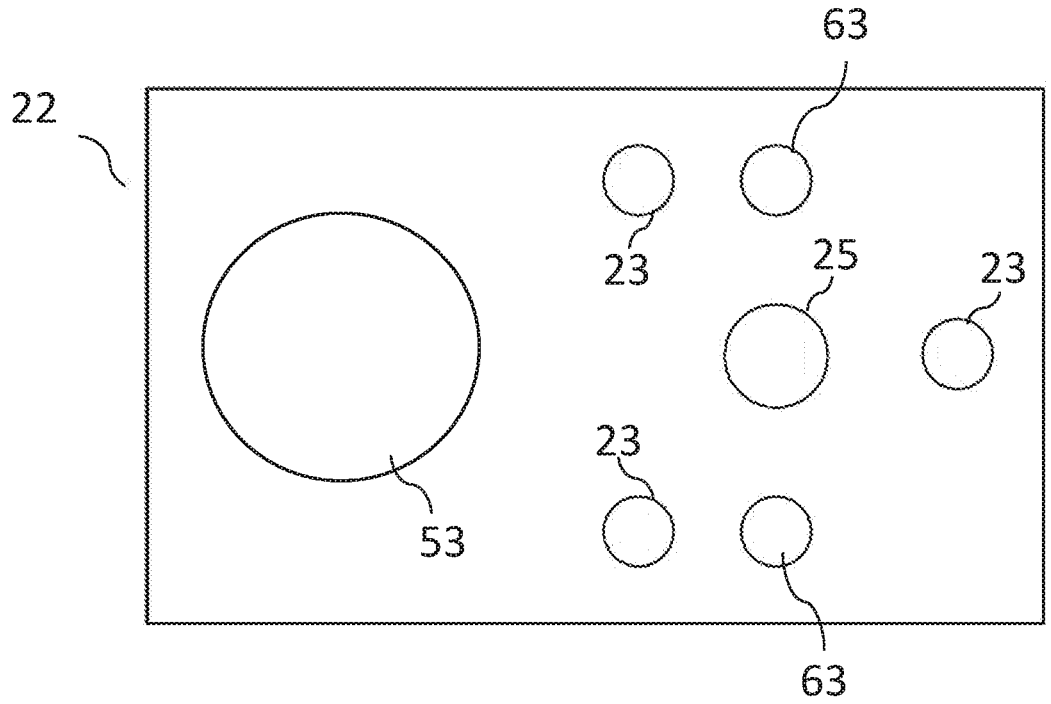
FIG. 3A is a bottom view of a top die plate of FIG. 1, according to some embodiments.

FIG. 3A shows the top die plate 22 from a bottom view. As shown, the top die plate 22 includes holes 23, 25, 53, 63 formed into the top die plate material. The holes 23, 25, 53, 63 may be sized to receive various protrusions for attachment or alignment, described further below. Holes 23, 25 may be threaded for receiving a bolt or screw having a complementary thread. Holes 63 may be relatively smooth for receiving a pin or bar that is inserted into holes 63. Hole 53 may be sized to provide clearance for the collet through the hole 53.

Figure 3B:
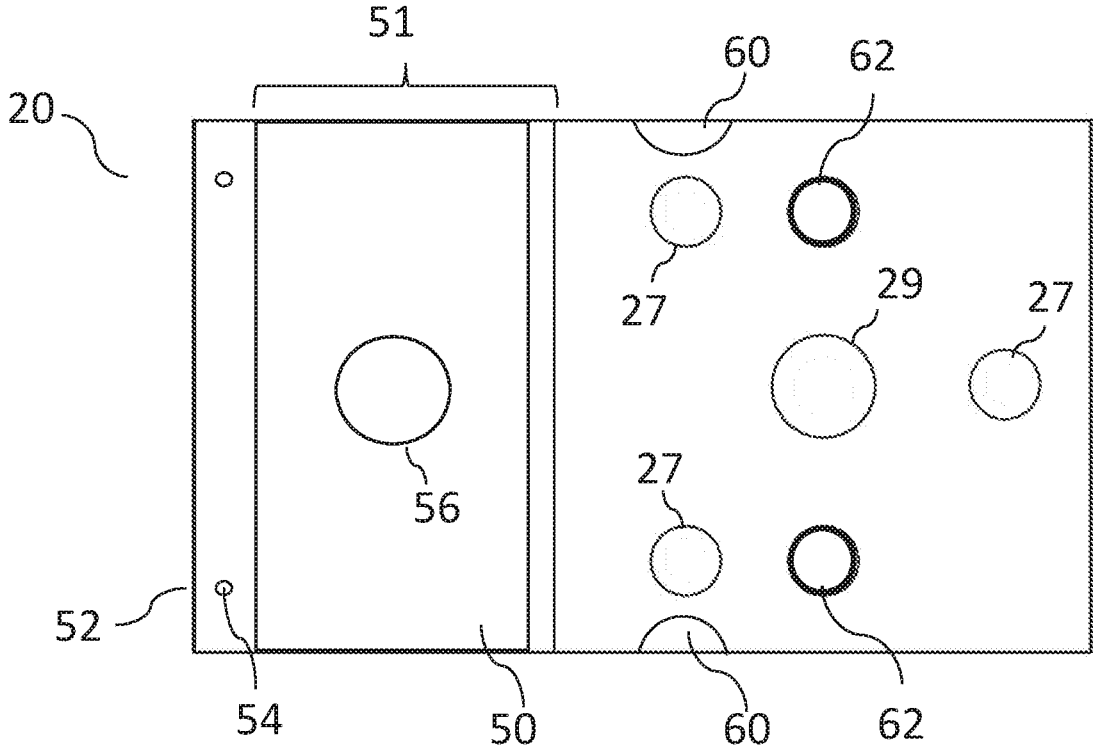
FIG. 3B is a top view of a bottom die plate of FIG. 1, according to some embodiments.

FIG. 3B shows the bottom die plate 20 from a top view. As shown, the bottom die plate 20 includes holes 27, 29 formed into the bottom die plate material. The bottom die plate 20 also includes alignment pins 62 that protrude from the top surface of the bottom die plate 20. The alignment pins 62 may be formed as rods or bars having relatively smooth sides. The alignment pins 62 may be received within holes 63 in the top die plate 22 (in FIG. 3A) to align the top die plate 22 and the bottom die plate 20. As shown, holes 27 may be formed part way through the bottom die plate material. Holes 27 may have relatively smooth sides for receiving a bolt or rod. In some embodiments, the bottom die plate 20 may include a toe clamp recess 60. The toe clamp recess 60 may be a cavity or recess formed into the bottom die plate 20 as shown. The toe clamp recess 60 may be a cavity formed partway through the bottom die plate material but does not extend completely through the bottom die plate material. The toe clamp recess 60 allows a clamp (not shown) of a press or arbor base plate to be placed within the toe clamp recess 60 to hold the bottom die plate 20. In this manner, the punch and die holding apparatus 2 can be held in place during operation. In some embodiments, a magnet (not shown), electrically or manually operated, could be embedded into the bottom die plate 20 to secure the punch and die holding apparatus to a press table. This may make removing the punch and die holding apparatus 2 from the press table faster. If a switch or lever is used to control the magnet without the need for tools, it may provide a quick release feature that does not require a user to loosen the toe clamp bolts.

As shown in FIG. 3B, the bottom die plate 20 also includes a die block pocket 51 for receiving the die 50. In some embodiments the die 50 is removably received in the die block pocket 51. In some embodiments, the die 50 is designed to slide into the bottom die plate 60 and be clamped in place with a die clamp 52. The die clamp 52 may be arranged to hold the die 50 against the bottom die plate 20 with a die clamp bolt 54. For example, the die 50 may be held with the die block pocket 51 formed in the bottom die plate 20 sized for the width and height of the die 50. The die clamp 52 is located on the bottom die plate 20 and may extend the width of the bottom die plate 20. The die 50 contains a die cavity 56. The die 50 is held to the die block 10 by inserting the die 50 into the die block pocket 51 and clamping the die 50 in place with the die clamp 52 by tightening the die clamp bolts 54.

FIG. 1 shows the bottom die plate 20 and the top die plate 22 attached to each other. As shown, the top die plate 22 and the bottom die plate 20 are generally flat sheets or plates of material. The bottom die plate 20 includes one or more alignment pins 62 that align the bottom die plate 20 to the top die plate 22. For example, alignment pins 62 may be a rod or rods extending between the top die plate 22 and the bottom die plate 20. As shown in FIG. 3A, the top die plate has holes 63 sized to receive the alignment pins 62 attached to the bottom die plate 20 (shown in FIG. 3B). The holes 63 may be formed as a straight or smooth hole for quick insertion of the alignment pins 62. In this way, the top die plate 22 may be aligned with the bottom die plate by inserting the alignment pins 62 on the bottom die plate 20 into the corresponding holes 63 in the top die plate 22. In this manner the top die plate 22 and bottom die plate 20 may first be arranged in lateral relation to each other in a first plane.

In some embodiments, the bottom die plate 20 and top die plate 22 may be formed from metal or a metallic alloy. For example, the bottom die plate 20 and top die plate 22 may be made from iron, tool steel, or stainless steel. In some embodiments, the top die plate 22 may be formed from iron, tool steel, or stainless steel. The bottom die plate 20 and top die plate 22 may be made from the same or similar material as each other.

As shown in FIG. 1, upon assembly, the die block 10 generally has a first plane, defined by the plates of the top die plate 22 and the bottom die plate 20. The bottom die plate 20 and top die plate 22 are held in place relative to each other by a combination of a die plate clamping bolt 24 and three or more gap opening stops 26, although fewer than three gap opening stops 26 are also contemplated according to some embodiments. The die plate clamping bolt 24 has a threaded shaft (not shown) that extends through a through hole 25 in the top die plate 22 (in FIG. 3A) and into a hole 29 in the bottom die plate 20 (in FIG. 3B). The hole 29 in the bottom die plate 20 includes female threads (not shown) that mate with threads on the shaft of the die plate clamping bolt 24. The top die plate 22 includes a plurality of holes 23 that are threaded for receiving the gap opening stops 26. The gap opening stops 26 have threaded shafts (not shown) that extend through the top die plate 22 and are adjusted to maintain a desired die gap 28 by adjusting them in the threaded holes 23 in the top die plate 22. The gap opening stops 26 extend through the top die plate 22 and into the holes 27 in the bottom die plate 20. The die gap 28 is a space that is defined between the bottom die plate 20 and top die plate 22 that is sized for the thickness of a plate of metal or other material that is intended to be punched or stamped. For example, after the top die plate 22 and the bottom die plate 20 are aligned using the alignment pins 62, the top die plate 22 and bottom die plate 20 may be attached to form the die block 10 using the gap opening stops 26 and die plate clamping bolt 24.

In various embodiments, the gap opening stops 26 can be adjusted to push against the top face of the bottom die plate 20 while the die clamping bolt 24 secures the plates 20, 22 together (i.e., by rotating the bolts into, or out of the corresponding threaded holes). In different terms, the gap opening stops 26 and die plate clamping bolt 24 are threaded and can be adjusted to simultaneously apply a force in opposing directions on the bottom die plate 20 and the top die plate 22 to maintain a die gap size. For example, the die plate clamping bolt 24 may be adjusted to apply a compressive force between the bottom die plate 20 and the top die plate 22. The gap opening stops 26 may be threaded or bolted to apply an expansive force between bottom die plate 20 and the top die plate 22. In such a configuration, the die gap 28 may be held at a constant size. The die gap 28 thus is prevented from expanding by the die plate clamping bolt 24 holding the bottom die plate 20 and the top die plate 22 together. Correspondingly, the die gap 28 can be prevented from contracting by the gap opening stops 26 holding the bottom die plate 20 and the top die plate 22 apart. The die gap 28 can also be adjusted by rotating the gap opening stops 26 and die plate clamping bolt 24 to form a suitable width. The gap opening stops 26 and die plate clamping bolt 24 may include markings that may be used in combination with markings on the die block 10 to allow a user to form a premeasured die gap 28 width, for example by aligning the markings with a visual marker on the die block 10. Although the gap opening stops 26 are shown "pushing" and the die clamping bolt 24 "pulling," the opposite arrangement (bolt 24 pushing and bolts 26 pulling) is also contemplated.

As shown in FIG. 3, the gap opening stops 26 are arranged in a triangle along the surface of the die block 10. The positions of the gap opening stops 26 are not limited to this shape or position and may be arranged in an alternative position or shape. For example, a larger number of gap opening stops 26 may be used, and can alternatively form a square, circular, or rectangular shape. As shown, the die plate clamping bolt 24 is shown arranged within the center of a triangle formed by the gap opening stops 26. However, the illustration of FIG. 3 is not limiting with regard to the locations of the various components. For example, the location of the alignment pins 62, gap opening stops 26, and die plate clamping bolt 24, may be rearranged and still achieve a similar result. An alternative arrangement may be used with the die plate clamping bolt 24 positioned relative to the gap opening stops 26 that provides structural support for holding the top die plate 22 and bottom die plate 20 together. It is also envisioned that multiple die plate clamping bolts 24 may be used in alternative arrangements. For example, gap opening stops 26 may be positioned in a square or rectangular shape with one or more die plate clamping bolts 24 arranged within the square or rectangle.

Figure 4:
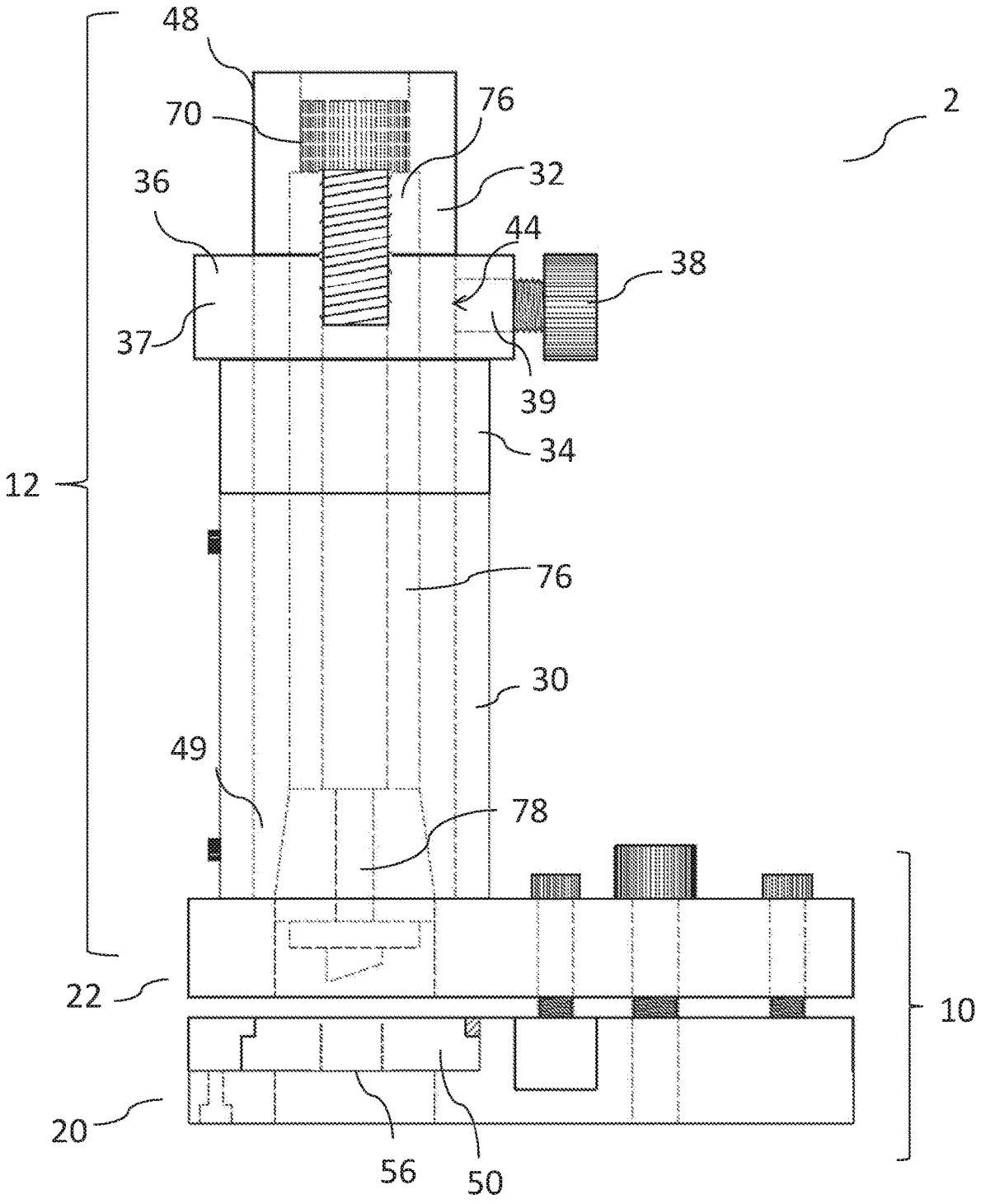
FIG. 4 is a side view of a punch and die holding apparatus, according to some embodiments.
Figure 14:
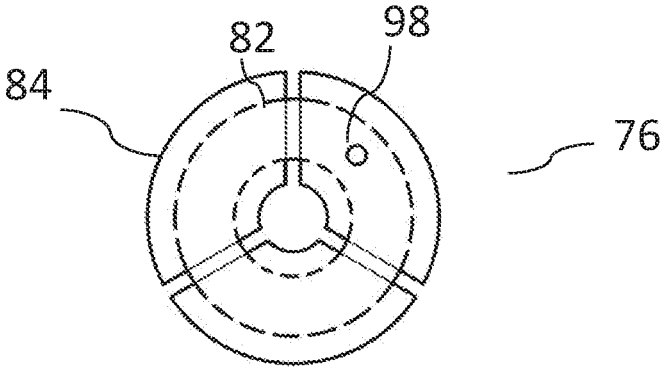
FIG. 14 is a bottom view of a collet, according to some embodiments.

As shown in FIG. 1, the punch holder 12 is sized and configured to work in combination with the die block 10. FIG. 4 contains an additional side view of the punch holder 12 showing the components as assembled. FIG. 4 shows the collet chuck guide tube 30, the resilient spring 34, the shaft collar 36, the shaft collar clamp bolt 38, the collet chuck 32, and the collet chuck closing bolt 70. FIG. 4 also shows various hidden features of the punch holder 12 in broken lines and FIG. 14 is a partial cut-away view showing various internal features of the punch holder 12 showing a collet 76, and a punch 78. FIG. 4 also shows a die hole or cavity 56 within the die 50. The guide tube 30, shaft collar 36, shaft collar closing bolt 38, collet 76, and punch 78 may be formed from metal or a metallic alloy. For example, the guide tube 30, shaft collar 36, shaft collar closing bolt 38, collet 76, and punch 78 may be may be made from any of tool steel or stainless steel.

Figure 5:
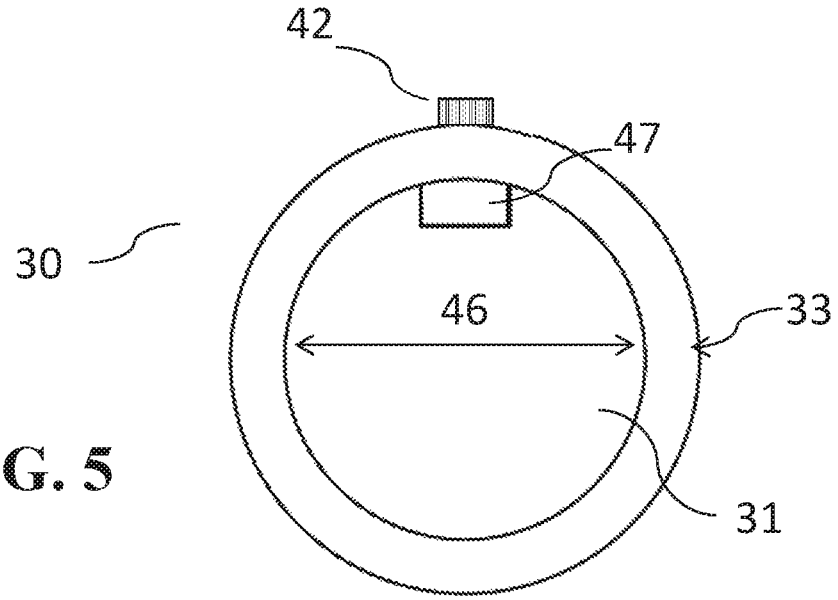
FIG. 5 is a top view of a guide tube of FIG. 1, according to some embodiments.
Figure 6:
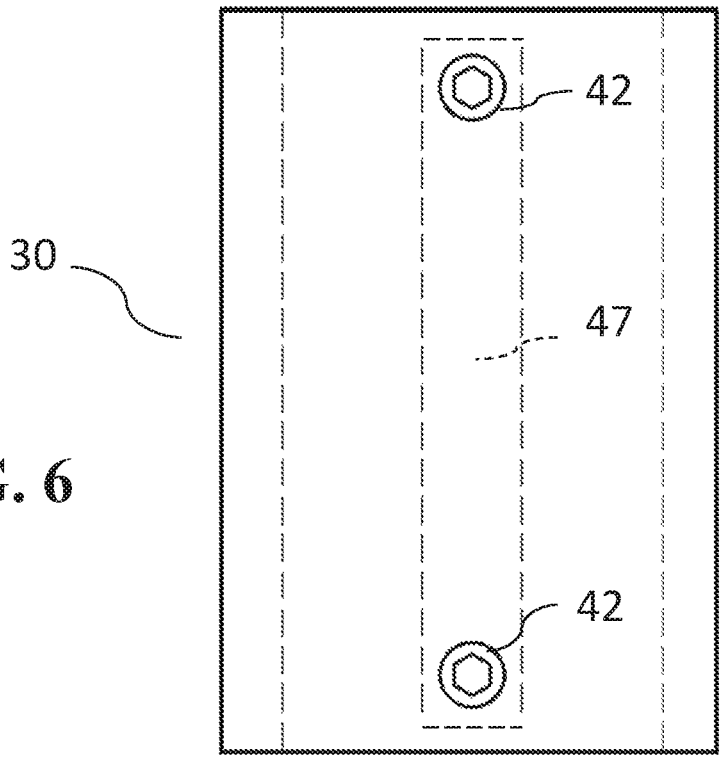
FIG. 6 is a side view of a guide tube of FIG. 1, according to some embodiments.
Figure 7:
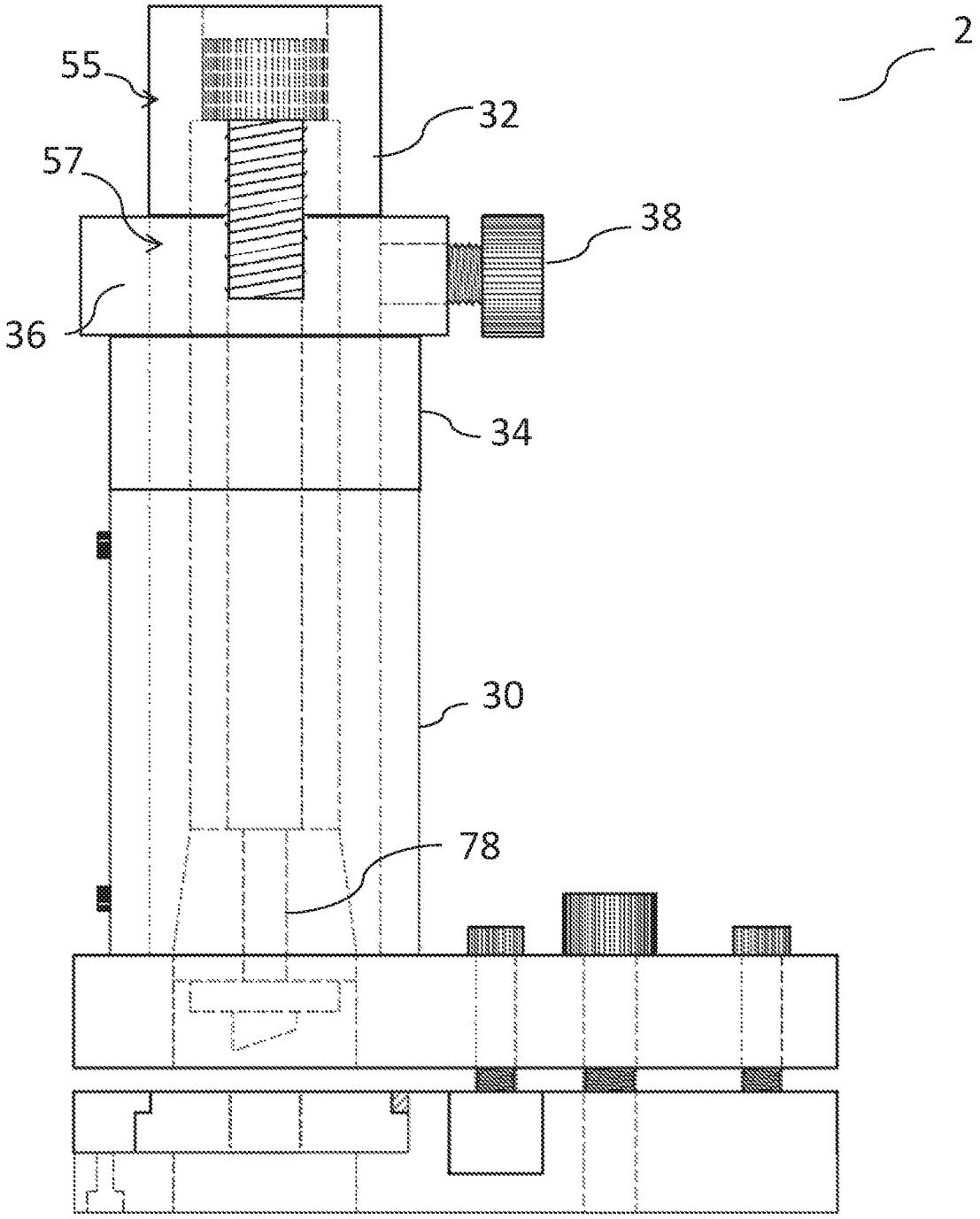
FIG. 7 is a side view of a punch and die holding apparatus, according to some embodiments.

As shown in FIG. 4, the punch holder 12 contains a collet chuck guide tube 30 also referred to herein as a guide tube. FIGS. 5 and 6 show the guide tube in further detail. FIG. 5 shows the guide tube 30 from a top view and FIG. 7 shows the guide tube 30 from a side view. In combination, FIGS. 5 and 6 show the guide tube 30 as a cylinder having a wall that defines an inner shaft or bore 31. The guide tube 30 is a generally cylindrical shape having an outer diameter, an inner diameter, and a length or height. The wall of the guide tube 30 defines a first thickness between the inner bore 31 and the outer surface 33. The guide tube 30 has a length sized to allow a portion of the guide tube to be within the die block 10 with a portion of the guide tube 30 remaining outside the die block 10, as shown in FIG. 4. For example, the top die plate 22 may define a recess (53 in FIG. 3A) sized to receive at least a portion of the guide tube 30. The top die plate 22 may define a round or circular recess (53 in FIG. 3A) formed through the top die plate 22 and sized to receive at least a length of the guide tube 30.

As shown in FIGS. 5 and 6 in some embodiments, the guide tube 30 wall has a hole or holes defined through the first thickness. For example, the guide tube 30 wall may have one or more threaded holes through the wall of the guide tube 30 extending from the outer surface 33 through to the inner bore 31 of the guide tube 30. The hole or holes may be threaded to received bolts or screws of various lengths. For example, as shown in FIGS. 5 and 6, one or more keyway bolts 42 may be inserted through the one or more holes. The keyway bolts 42 may be a bolt or screw with a thread that allows a user to advance the keyway bolts or bolts 42 through the guide tube wall. In some embodiments, the keyway bolts 42 are advanced through the guide tube 30 wall and extend past an inner diameter 46 of the guide tube 30. The keyway bolts 42 are generally sized with a length that provides a portion of the keyway bolts 42 to extend through the guide tube 30 wall and extend into the keyway 40. In some embodiments, within the guide tube bore 31, a key 47 may be attached. The key 47 may be attached to guide tube 30 by threading the keyway bolts 42 from the outer surface 33 of the guide tube, through the guide tube wall, and into the inner bore 31 of the guide tube 30. The key 47 may be an elongated piece of material that extends inward from the inner diameter 46 of the guide tube 30 and protrudes partway into the bore 31.

As shown in FIG. 4, the punch holder 12 contains a resilient spring 34. When assembled, the resilient spring 34 is typically located adjacent to the guide tube 30. The resilient spring 34 may be circular or round. The resilient spring 34 may generally be a cylinder having an outer diameter and an inner diameter. In some embodiments, the outer diameter and the inner diameter of the resilient spring 34 may be the same as the outer diameter and the inner diameter of the guide tube 30. In some embodiments, the outer diameter and the inner diameter of the resilient spring 34 may be greater than or less than the outer diameter and the inner diameter of the guide tube 30. In general, the inner diameter of the resilient spring 34 should be less than the outer diameter of the guide tube 30. This size relationship prevents the resilient spring from sliding along the outside of the guide tube 30 and/or coming out of position during operation.

The resilient spring 34 may be formed from a material that retains a compressive force and expands after the force has been released. For example, the resilient spring 34 may be formed from a cylinder or tube of a material having an elastic response to a compressive force such as polyurethane, rubber, or other polymers. In some embodiments, the elastic spring comprises a polyurethane spring having a elastic modulus from about 69 MPa to about 690 MPa. In another example, the resilient spring 34 may comprise alternative configurations, such as a coiled metal spring.

As shown in FIG. 4, the punch holder 12 includes a shaft collar 36 above the resilient spring 34. As shown, the shaft collar 36 is generally a round or cylindrical ring. The shaft collar 36 has an inner diameter, and outer diameter and a length. The shaft collar 36 has a wall 37 with a thickness defined by the inner diameter and outer diameter of the wall 37. The shaft collar 36 has a hole 39 through the wall 37. A shaft collar clamp bolt 38 can be placed through the hole 39 in the shaft collar 36. The shaft collar clamp bolt 38 may be sized with a length to extend though the shaft collar wall 37 and extend past the inner diameter of the shaft collar 36. For example, the shaft collar clamp bolt 38 may be sized with a length to allow the shaft collar clamp bolt 38 to extend from the outer diameter of the shaft collar 36 wall 37 and extend past the inner diameter of the shaft collar 36 into a bore of the shaft collar 36. The shaft collar 36 typically is located above the resilient spring 34. In some embodiments, the outer diameter and the inner diameter of the shaft collar 36 may be the same as the outer diameter and the inner diameter of the guide tube 30. In some embodiments, the outer diameter and the inner diameter of the shaft collar 36 may be greater than or less than the outer diameter and the inner diameter of the guide tube 30.

As shown in FIG. 7, in some embodiments the shaft collar 36 may be connected to the collet chuck 32 for the punch and die holding apparatus 2. In some embodiments, the collet chuck 32 may have threads on at least a portion of the external surface 55. Additionally, the shaft collar 36 may have a threaded surface on an internal surface 57. The threads on the internal surface 57 of the shaft collar 36 are sized to engage the threads on the external surface 55 of the collet chuck 32. This embodiment provides fine adjustment of the distance between the punch 78 and the material being punched to minimize travel distance of the punch 78 during operation. Rotational movement of the shaft collar 36 imparts longitudinal movement of the collet chuck 32 in relation to the guide tube 30 and resilient spring 34. Tightening the shaft collar clamp bolt 38 secures it in place.

Figure 8:
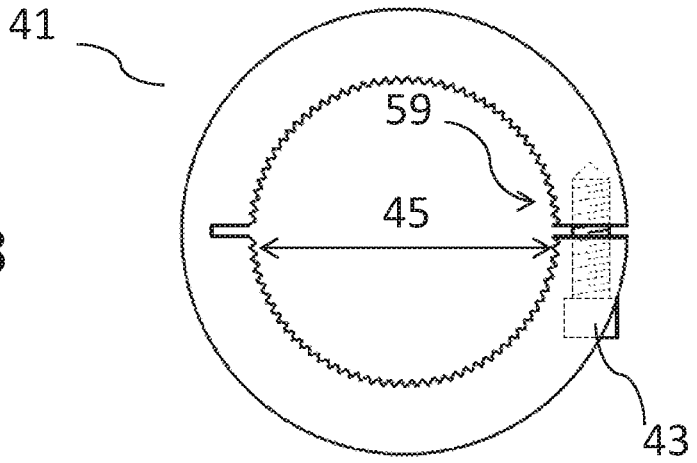
FIG. 8 is a top view of an embodiment of a shaft collar that may be used with the punch and die holding apparatus.

An alternative embodiment of a shaft collar 41 that may be used with the punch and die holding apparatus 2 is shown in FIG. 8. In some embodiments, shaft collar 41 may be a clamping collar. The shaft collar 41 has a C-shaped configuration with an internal diameter 45. The internal diameter 45 of the shaft collar 41 may be reduced by tightening a clamping bolt 43 that is positioned tangentially to the curvature of the shaft collar 41. The internal surface 59 of the shaft collar 41 may be threaded.

Figure 9:
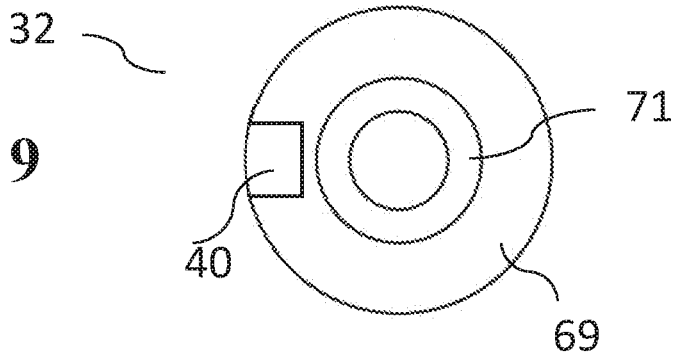
FIG. 9 is a top view of a collet chuck of the punch and die holding apparatus of FIG. 1, according to some embodiments.
Figure 10:
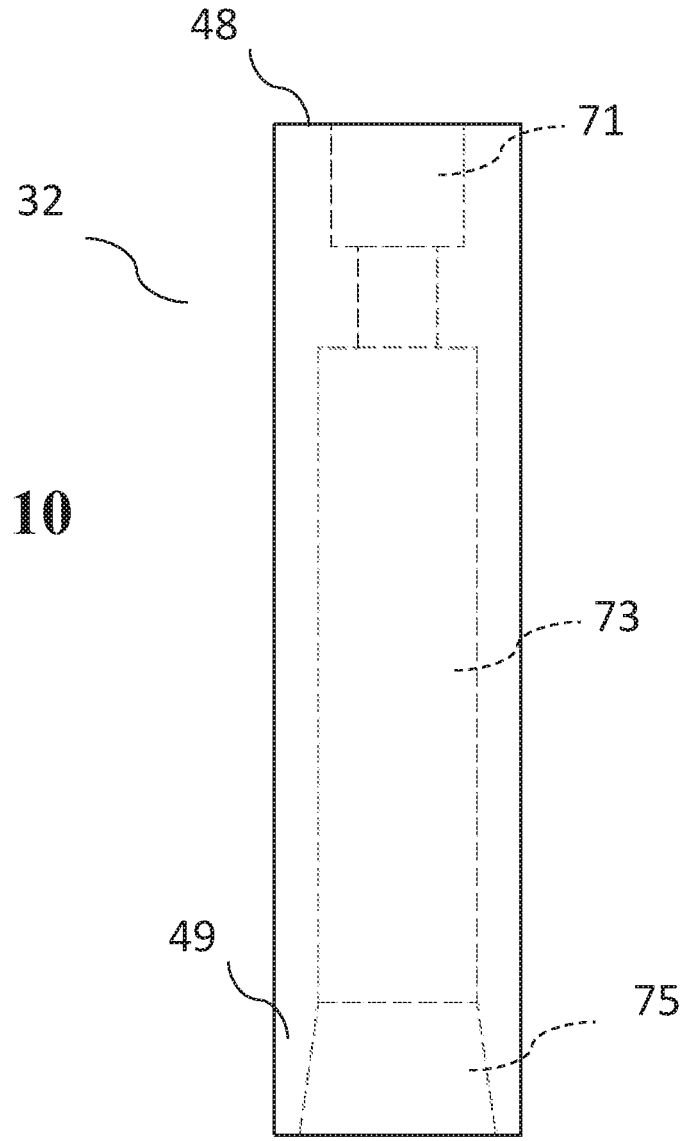
FIG. 10 is a front view of the collet chuck of the punch and die holding apparatus of FIG. 1, according to some embodiments.

FIGS. 9 and 10 show the collet chuck 32 of FIG. 4 separated from the punch holder 12. FIG. 9 shows the collet chuck 32 of FIG. 4 separated from the punch holder 12 from a top view. FIG. 10 shows the collet chuck 32 separated from the punch holder 12 from a side view. As shown in FIGS. 9 and 10, the collet chuck 32 generally is formed as a cylinder having an outer diameter and an inner diameter and a wall 69 in between, according to various embodiments. The outer diameter of the collet chuck 32 is sized to allow the collet chuck 32 to fit within the guide tube 30. The collet chuck 32 has a first recess 71 sized to accommodate the collet chuck closing bolt (70 in FIG. 4). FIG. 10 shows the collet chuck 32 separated from the punch holder 12 from a side view. As shown in FIG. 10, the collet chuck 32 includes a first end 48 and a second end 49, with a length defined in between. As shown in FIG. 4, the collet chuck 32 may be sized with a length that allows a portion of the collet chuck 32 to be inserted within the guide tube 30 and the resilient spring 34 with the first end 48 of the collet chuck 32 to remain outside the guide tube 30, resilient spring 34, and shaft collar 36.

As shown in FIG. 9, the collet chuck 32 contains a keyway 40 on at least one side. The keyway 40 may be a channel in the wall 69 of the collet chuck 32 having a width. In some embodiments, the keyway 40 extends the entire length of the collet chuck 32. The keyway 40 may extend only partway along the length of the collet chuck 32. The length and width of the keyway 40 are sized to receive a key 47 that is attached to the guide tube 30. For example, as shown above in FIG. 6, the guide tube 30 may have one or more keyway bolts 42 that are attached to a key 47 and hold the key 47 to the inside of the guide tube bore 31. The key 47 is sized with a width that allows it to fit within the width of the keyway 40 of the collet chuck 32. The key 47 within the keyway 40 inhibits the collet chuck 32 from rotating in relation to the guide tube 30 when the collet chuck 32 is inserted within the guide tube 30.

As shown in FIG. 10, the collet chuck 32 has a first recess 71 at the first end 48 sized to accommodate the collet chuck closing bolt (70 in FIG. 4). The collet chuck 32 has a second recess 73, 75 that is sized to receive the collet 76. In general, the collet chuck second recess 73, 75 has a first portion 73 having a cylinder with straight walls, and a second portion 75 having an angular or slanted wall that tapers inward in the axial direction of the collet chuck 32. The collet chuck 32 second portion 75 typically has a tapered receiving sleeve. In general, the second portion 75 has an inner diameter that is wider than the inner diameter of the first portion 73 and narrows down to the diameter of the first portion 73. The combination of the second recess having the first portion 73 and the second portion 75 form a receiving sleeve for receiving the collet 76.

Figure 11:
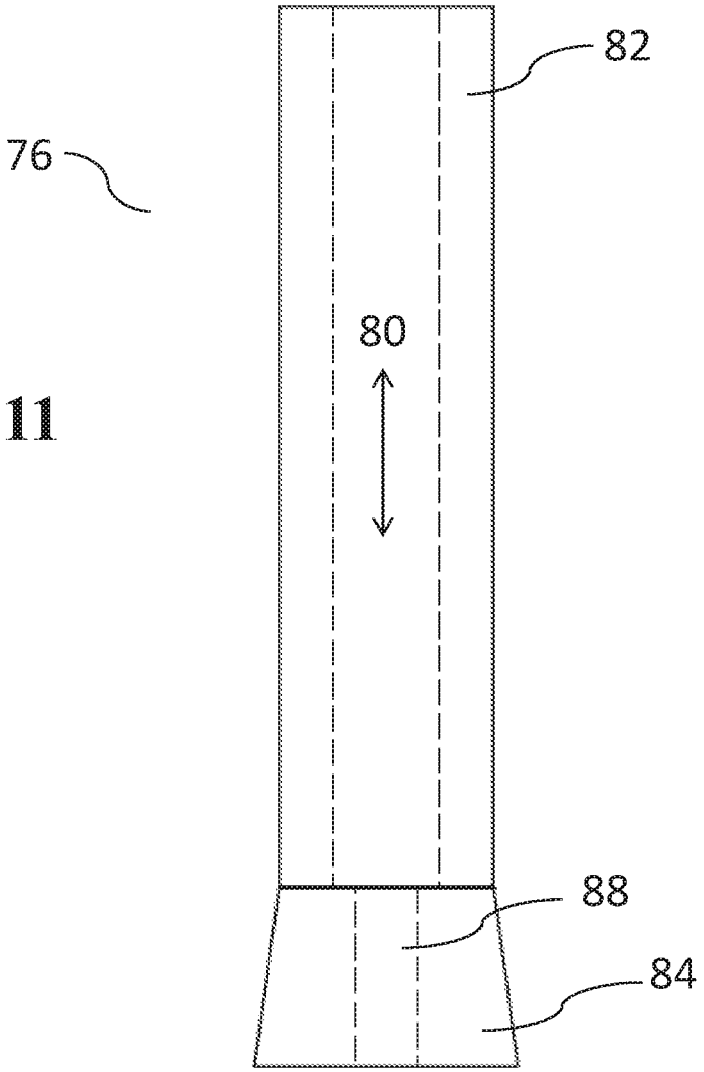
FIG. 11 is a front view of a collet of the punch and die holding apparatus of FIG. 1, according to some embodiments.
Figure 12:
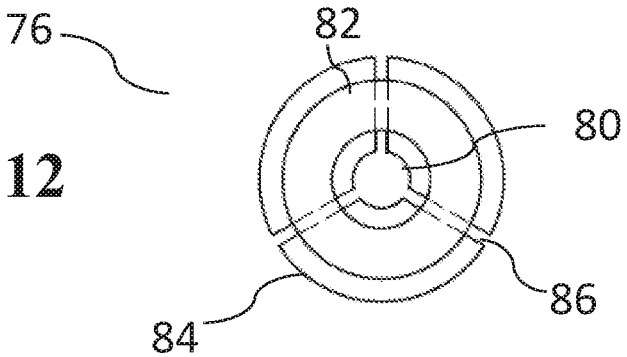
FIG. 12 is a top view of the collet of the punch and die holding apparatus of FIG. 1, according to some embodiments.

FIGS. 11 and 12 show the collet separated from the punch holder 12. FIG. 11 is a side view of the collet 76. FIG. 12 is a top view of the collet 76 as viewed along the length of the collet 76 from the collet first end 82. As shown in FIG. 11, the collet 76 has a generally cylindrical first end 82 and a second end 84 generally shaped as a truncated cone. The collet 76 typically has a bore down the center 80. At least a portion of the center 80 of the collet is threaded within the bore at the first end 82. At least a portion of the center 80 of the collet second end 84 is a relatively smooth bore. For example, a punch holder may be located within the center of the second end 84 and have a smooth internal bore 88.

As shown in FIG. 12 the collet 76 first end 82 is narrower than the truncated cone of the second end 84. The center 80 of the collet 76 has a bore at the first end 82. The second end 84 of the collet 76 has slits 86 formed into the truncated cone. The slits 86 typically extend the length of the truncated cone. To assemble the collet 76 with the collet chuck 32, the collet 76 is inserted into the receiving sleeve 73, 75 of the collet chuck 32 (shown in FIG. 10). The collet chuck closing bolt 70 slides through the first end 48 of the collet chuck 32 and screws into the first end 82 of the collet 76. The collet 76 is thus clamped into the collet chuck 32 by tightening the collet chuck closing bolt 70. The collet chuck closing bolt 70 is positioned at the first end 48 of the collet chuck 32. The closing bolt 70 is also connected to the collet 76 and holds the collet 76 in place within the collet chuck 32. This assembled configuration is illustrated further in FIG. 20 below.

Figure 13A:
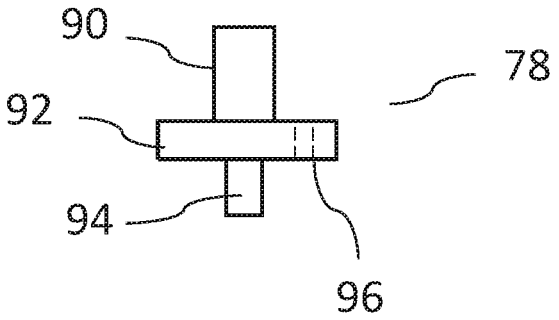
FIG. 13A is a front view of a punch of the punch and die holding apparatus of FIG. 1, according to some embodiments.

FIG. 13A is a side view, illustrating a punch 78 that can be used with the punch holder 12. As shown in FIG. 13A, the punch 78 typically has a punch stem 90 for holding the punch 78, a punch head 94, and a center portion 92 between the punch stem 90 and the punch head 94. In some embodiments, the center portion 92 is wider than the punch head 94 and the punch stem 90. In some embodiments, the center portion 92 includes a punch guide 96. The punch guide 96 is generally a hole or bore in the center portion 92 that can be used to align the punch 78 with the collet 76 (shown below in FIG. 14).

Figure 13B:
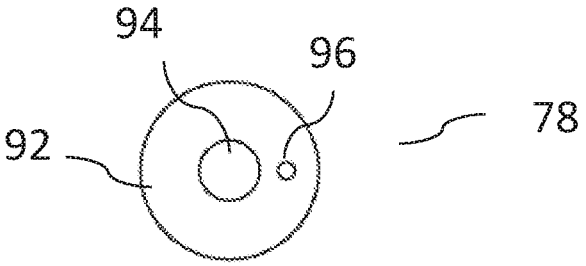
FIG. 13B is a top view of a punch of the punch and die holding apparatus of FIG. 1, according to some embodiments.

FIG. 13B is a top view of the punch 78 of FIG. 13A showing the punch head 94, the center portion 92, and the punch guide 96. As shown in FIG. 13B, in some embodiments, the punch head 94 may be a generally circular shape. However, any shape that is suitable for a user may be created. For example, shapes such as a heart, star, circle, oval, square, rectangle, or any others may be used. Various sized punch heads 94 may also be created.

FIG. 14 is a bottom view of the collet as viewed along the length of the collet 76 from the collet second end 84 to illustrate how the punch of FIGS. 13A and 13B may be connected. The dashed line indicates the diameter of the collet first end 82 in relation to the diameter of the truncated cone of the collet second end 84. Also shown in FIG. 14 is a punch alignment pin 98 that may be used to align a punch 78 with the collet 76 by inserting the punch alignment pin 98 into the punch guide 96, shown in FIGS. 13A and 13B.

Figure 15A:
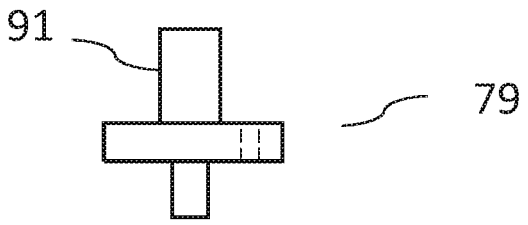
FIG. 15A is a front view of a punch that may be used with the punch and die holding apparatus of FIG. 1, according to some embodiments.
Figure 15B:
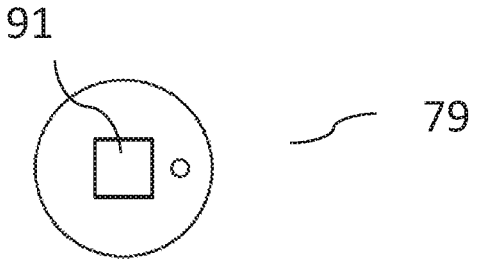
FIG. 15B is a top view of a punch that may be used with the punch and die holding apparatus of FIG. 1, according to some embodiments.
Figure 16:
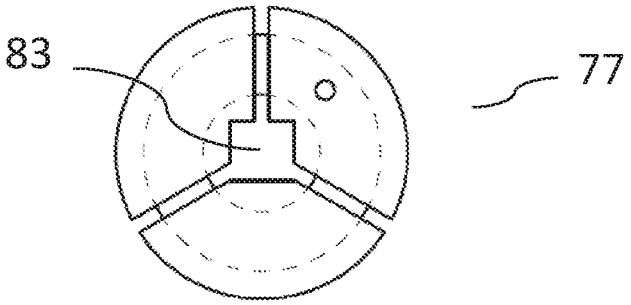
FIG. 16 is a bottom view of a collet that may be used in combination with the punch of FIGS. 15A and 15B, according to some embodiments.

FIGS. 15A and 15B show an alternative embodiment of a punch 79 that may be used. As shown in FIGS. 15A and 15B, in some embodiments, the punch 79 may have a polygon shaped stem 91. FIG. 16 is a bottom view of an embodiment of a collet 77 that may be used to hold the punch 79 of FIGS. 15A and 15B. As shown in FIG. 16, a bore 83 to accept a punch stem 91 of the same polygon shape of the punch stem 91 of the punch 79 of FIGS. 15A and 15B may be used in order to align the punch 79 within the collet 76 and die 50 of FIG. 4 for example.

Figure 17:
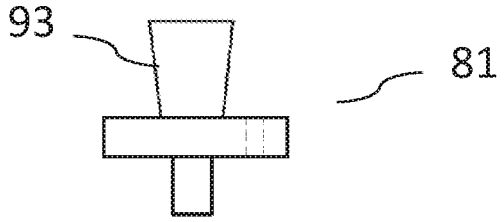
FIG. 17 is a front view of a punch that may be used with the punch and die holding apparatus of FIG. 1, according to some embodiments.
Figure 18:
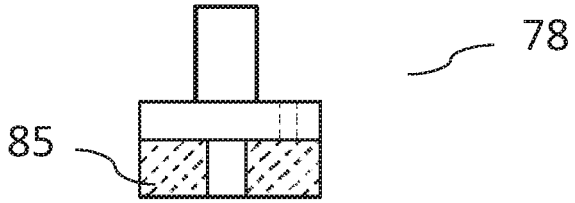
FIG. 18 is a front view of a punch that may be used with the punch and die holding apparatus of FIG. 1, according to some embodiments.
Figure 19:
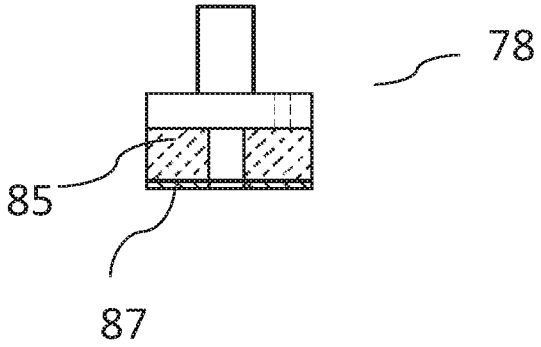
FIG. 19 is a front view of a punch that may be used with the punch and die holding apparatus of FIG. 1, according to some embodiments.

As shown in FIG. 17, an alternative embodiment of a punch 81 may have a punch stem 93 that is tapered to prevent the punch 81 from being pulled out of the collet 76 when the collet chuck 32 retracts after a part is stamped. As shown in FIG. 18 in some embodiments, a resilient spring 85 is attached to the punch 78 of FIGS. 13A and 13B in order to press the material against the die 50 prior to the punch 78 contacting the material. The resilient spring 85 pressing against the material prevents bending of the material as it is punched. The resilient spring 85 also can serve as a part stripper if the force to punch a part is less than the force imparted by the resilient spring 85. The resilient spring 85 can be polyurethane or a conventional compression type spring. As shown in FIG. 19, in some embodiments, the resilient spring 85 attached to the punch 78 may have a metal disc 87 affixed to the end of the resilient spring 85 that contacts the material being punched. In some embodiments, the metal disc 87 has a larger diameter than the resilient spring 85 to provide more contact area.

Figure 20:
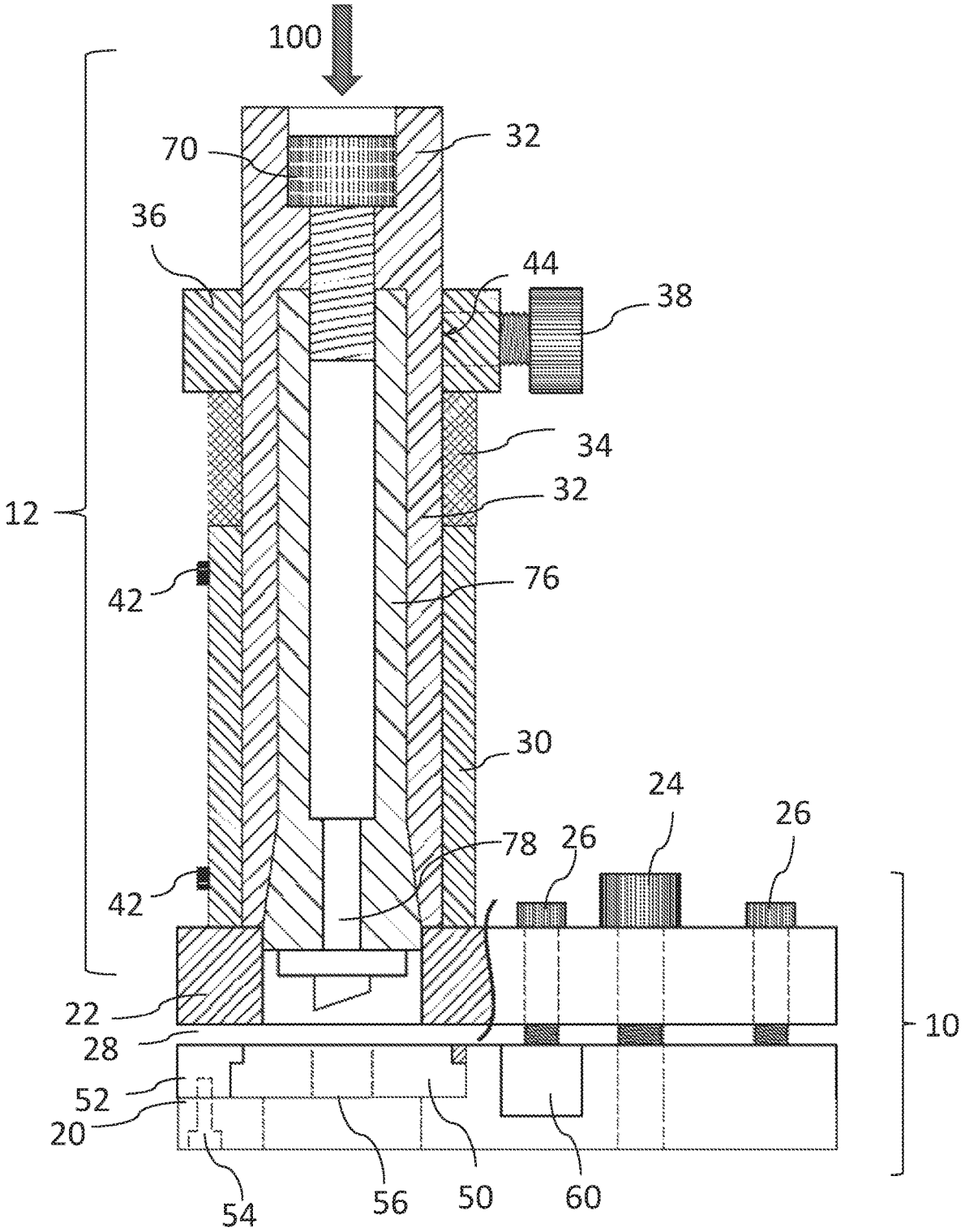
FIG. 20 is a partial cutaway view of the punch and die holding apparatus of FIG. 1, according to some embodiments.

FIG. 20 shows components previously described in FIGS. 6-14 in an assembled configuration. As shown, the punch stem 90 is inserted into the collet 76 at the collet second end 84. The collet 76 is inserted into the receiving sleeve 73, 75 of the collet chuck 32, which has a matching taper as the truncated cone of the collet second end 84. The collet closing bolt 70 may be then be tightened, drawing the collet 76 into the collet chuck 32. As the collet 76 is drawn into the collet chuck 32 the truncated cone is pulled into the tapered surface of the collet chuck 32 second portion 75. Since the collet second end 84 has slits in the truncated cone, the center bore 80 of the collet second end 84 compresses inward such that its inner surface contracts to a slightly smaller diameter, squeezing the punch stem 90 resulting in high static friction between the collet second end inner bore 88 and the punch stem 90. This configuration will hold the punch 78 in place with the collet 76 and collet chuck 32 quite securely.

FIG. 20 illustrates various components previously described to illustrate how they fit together in some embodiments. As shown in the schematic of FIG. 20, in some embodiments, the die block 10 is formed from the bottom die plate 20 and top die plate 22 held together with the die plate clamping bolt 24 and the gap opening stops 26. The die gap 28 is defined by the distance between the bottom die plate 20 and the top die plate 22 and is generally sized to allow a sheet of material to be punched to fit within the die gap 28. The die gap 28 may be sized by adjusting the die plate clamping bolt 24 and the gap opening stop 26 or stops.

Shown in FIG. 20, the inner diameter of the resilient spring 34 and the shaft collar 38 are generally the same as the inner diameter 36 of the guide tube 30. It is preferred that the inner diameters of the guide tube 30, resilient spring 34, and shaft collar 36 are sized to be large enough to accommodate the collet chuck, yet narrow enough to reduce excessive movement of the collet chuck within the guide tube 30, resilient spring 34, and shaft collar 36 during operation. The shaft collar clamp bolt 38 is shown with a length extending through the wall of the shaft collar 36 and contacting the collet chuck 32 at the collet chuck outer surface 44. This configuration allows the shaft collar clamp bolt 38 to apply a frictional force against the collet chuck 32 outer surface 44 and hold the collet chuck in rotational and longitudinal relation to the shaft collar 36. The collet chuck closing bolt 70 is attached to the collet chuck 32 to hold the collet 76 within the collet chuck 32.

In some embodiments, the punch holder 12 includes a collet chuck guide tube 30 that is adjacent to a resilient spring 34 that is in turn adjacent to a shaft collar 36. A punch 78 is inserted into the collet inner bore 88 at the second end 84 of the collet 76. The collet 76 is inserted into the collet chuck 32 and the collet closing bolt 70 is tightened. By tightening the collet closing bolt 70, the collet 76 is drawn into the collet chuck 32. As the collet 76 is drawn into the collet chuck 32, the truncated cone of the collet 76 is compressed and the collet 76 inner bore squeezes against the punch 78, holding it in place.

In some embodiments, the collet chuck 32 containing the collet 76 and the punch 78 is inserted into the shaft collar 36, the resilient spring 34, and the guide tube 30. The shaft collar clamp bolt 38 is turned and bolted into the shaft collar 36. The shaft collar clamp bolt 38 is tightened until enough friction is maintained with the outer surface 44 of the collet chuck 32 to hold it in place within the shaft collar 36. The keyway bolts 42 may be turned to allow them to extend through the wall of the guide tube 30 and extend past the inner surface of the guide tube 30. The keyway 40 (shown above) is aligned with the keyway bolts 42 to align the collet chuck 32 and the punch 78 with the die 50.

The punch holder 12 is typically inserted through the top die plate 22 and the guide tube 30 is held in place in relation to the die block 10 by the top die plate 22. When stationary, the punch holder 12 holds the punch above the die gap 28 and aligns the punch 78 with the die cavity 56. The punch and die holding apparatus may be held in place, for example on a hydraulic press, by clamping the die block 10 to the press with the toe clamp recess 60.

In operation, the punch is held outside the die gap 28 and in alignment with the die cavity 56. A piece of material to be punched, generally in the form of a sheet, is placed within the die gap 28. A hydraulic or manual press may exert a force it the direction of the arrow 100.

During operation, the shaft collar clamp bolt 38 is extended through the shaft collar 36 wall and contacts the collet chuck 32 outer surface 44. If the shaft collar clamp bolt 38 is extended far enough through the shaft collar 36 wall, the shaft collar clamp bolt 38 applies a frictional force to the collet chuck outer surface 44. This frictional force holds the shaft collar 36 in place around the collet chuck 32. By holding the shaft collar 36 in place, the shaft collar 36 is prevented from sliding along the collet chuck 32 in a longitudinal direction. Thus if a force is applied to the collet chuck 32 in a longitudinal direction, the shaft collar 36 moves with the collet chuck 32. Thus when a force is applied in the direction shown by arrow 100, the collet chuck 32 moves in the direction 100 of the force, and the shaft collar 36 moves as well. The shaft collar 36 is pushed against the resilient spring 34 which is consequently pressed against the guide tube 30. The guide tube 30 is held in place by the die block 10. Thus the resilient spring 34 is compressed between the guide tube 30 and the shaft collar 38. As a result, the resilient spring 34 compresses, allowing the collet chuck 32 to extend through the guide tube 30 and into the die block 10. The punch 78 then may extend through the material to be stamped and continue through into the die cavity 56 creating a stamping. Once the force is released, the resilient spring 34 expands back and pushes the collet chuck 32 back to its original location along the guide tube 30.

Various features and related advantages will be recognized from the foregoing description. For example, using the embodiments disclosed herein, a punch and die holding apparatus can be assembled. The punch and die holding apparatus helps provide a relatively simple way of creating a wide variety of stampings of various shapes and sizes. If a user wants to change the punch 78, the punch 78 can be quickly changed by removing the collet chuck 32 from the guide tube 30. Because of the design disclosed above, the collet chuck 32 can be removed from the guide tube 30 without the use of tools; for example, the collet chuck 32 can slide out of the guide tube 30. The collet chuck closing bolt 70 is loosened using a wrench or hex key which releases the punch 78 from the collet 76. A new punch 78 may be placed into the collet 76, which is then tightened around the punch 78 by turning the collet chuck closing bolt 78. The collet chuck 32 containing the collet 76 and new punch 78 is then replaced in the shaft collar 36, resilient spring 34, and guide tube 30 to form the punch holder 12. The punch holder 12 is then placed into the die block 10 and can be used to form stampings.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A punch and die holding apparatus comprising:

a die block including a main body having a bottom die plate defining a die recess and forming a die clamp, a top die plate defining a guide tube cavity, the bottom die plate and top die plate defining a punch receiving gap, a die plate clamping bolt engaged with the bottom die plate and top die plate, and a plurality of gap opening stops engaged with the bottom die plate and top die plate;

a punch holder, at least partially disposed within the guide tube cavity, having a guide tube forming a first cylinder having a first end, a second end, and a wall extending between the first end and second end, a collet chuck at least partially inserted within the guide tube, the collet chuck defining a second cylinder having a first end, a second end, and a wall extending between the first end and second end, and an inner diameter and an outer diameter, a collet inserted within the collet chuck, the collet forming a first end and a second end and an inner bore and outer diameter, and a punch having a first end comprising a stem, a second end comprising a punch protrusion, and a central portion, the punch stem configured to be inserted into the second end of the collet, wherein the punch is within the collet, the punch stem is within the second end of the collet, and the second end of the collet is in contact with the punch stem around a circumference of the punch stem;

a collet closing bolt located at the collet first end wherein the second end of the collet is configured to tighten around the punch stem by turning the collet closing bolt at the collet first end; and a die received within the die recess.

2. The punch and die holding apparatus of claim 1, wherein the punch stem has a width less than an inner bore of the collet second end, and the central portion of the punch has a width that is greater than an inner bore of the collet.

3. The punch and die holding apparatus of claim 2, wherein the punch stem has a first end farthest from the punch central portion and a second end adjacent to the punch central portion, and wherein the punch step is tapered such that an outer diameter of the punch stem first end is larger than an outer diameter of the punch stem second end.

4. The punch and die holding apparatus of claim 1, wherein a plate gap is defined between the bottom die plate and top die plate, wherein the size of the plate gap is adjustable by manipulating the die plate clamping bolt and the plurality of gap opening stops.

5. The punch and die holding apparatus of claim 1, further comprising a keyway guide including a channel in the collet chuck wall extending from the first end of the collet chuck to the second end of the collet chuck, the guide tube defining a hole extending through the guide tube wall, and a keyway guide bolt extending through the hole in the guide tube wall and received with the collet chuck wall channel, wherein the position of the keyway guide bolt within the hole in the guide tube wall controls rotational motion of the collet chuck within the guide tube.

6. The punch and die holding apparatus of claim 1, further comprising a shaft collar including a ring having a first thickness in a longitudinal direction and a second thickness in a radial direction, the ring surrounding a portion of the collet chuck that is not within the guide tube, a bolt hole through the second ring thickness, and a clamp bolt penetrating through the bolt hole in an inward radial direction such that advancing the clamp bolt radially inward provides frictional engagement with the collet chuck wall.

7. The punch and die holding apparatus of claim 6, further comprising an elastic spring including a ring having a first thickness in a longitudinal direction and a second thickness in a radial direction, the elastic spring surrounding a portion of the collet chuck between the collet chuck shaft and the shaft collar.

8. The punch and die holding apparatus of claim 7, wherein the elastic spring comprises a polyurethane spring having an elastic modulus appropriate to material being punched and the thickness and cross sectional area being punched.

9. The punch and die holding apparatus of claim 7, further comprising a locating pin in the collet and a locating hole in the central area of the punch, the locating pin configured to be received within the locating hole to provide repeatable orientation of the punch within the collet and die located on the bottom die plate.

10. The punch and die holding apparatus of claim 1, further comprising a clamp-on shaft collar having a circular shape, and having an outer diameter defining an outer surface, an inner diameter defining an inner surface, a first thickness defined between the outer and inner diameter, a first end, a second end, a second thickness defined between the first end and second end, the inner surface being threaded, a hole through the first thickness in a direction tangential to the inner diameter, and configured to receive a shaft collar bolt through the hole, wherein turning the shaft collar bolt decreases the inner diameter of the shaft collar.

11. The punch and die holding apparatus of claim 1, wherein the collet inner bore defines a polygonal bore.

12. The punch and die holding apparatus of claim 1, further comprising a punch spring attached to the punch central portion and extending from the punch central portion and surrounding the punch protrusion.

13. The punch and die holding apparatus of claim 1, further comprising a punch spring having a first end attached to the central portion, a second end, a central body between the first end and second end and surrounding the punch protrusion, and a metal disc attached to the punch spring second end.

14. A punch and die holding apparatus comprising:

a die block including a main body having a bottom die plate defining a die recess and forming a die clamp, a top die plate defining a guide tube cavity, the bottom die plate and top die plate defining a punch receiving gap, a die plate clamping bolt engaged with the bottom die plate and top die plate, and a plurality of gap opening stops engaged with the bottom die plate and top die plate;

a punch holder, at least partially disposed within the guide tube cavity, having a guide tube forming a first cylinder having a first end, a second end, and a wall extending between the first end and second end, a collet chuck at least partially inserted within the guide tube, the collet chuck defining a second cylinder having a first end, a second end, and a wall extending between the first end and second end, and an inner diameter and an outer diameter, a collet inserted within the collet chuck, the collet forming a first end and a second end and an inner bore and outer diameter, and a punch having a first end comprising a stem, a second end comprising a punch protrusion, and a central portion, the punch stem configured to be inserted into the second end of the collet;

a die received within the die recess; and a shaft collar including a ring having a first thickness in a longitudinal direction and a second thickness in a radial direction, the ring surrounding a portion of the collet chuck that is not within the guide tube, a bolt hole through the second ring thickness, and a clamp bolt penetrating through the bolt hole in an inward radial direction such that advancing the clamp bolt radially inward provides frictional engagement with the collet chuck wall.

15. The punch and die holding apparatus of claim 14, further comprising an elastic spring including a ring having a first thickness in a longitudinal direction and a second thickness in a radial direction, the elastic spring surrounding a portion of the collet chuck between the collet chuck shaft and the shaft collar.

16. The punch and die holding apparatus of claim 15, wherein the elastic spring comprises a polyurethane spring having an elastic modulus appropriate to material being punched and the thickness and cross sectional area being punched.

17. The punch and die holding apparatus of claim 15, further comprising a locating pin in the collet and a locating hole in the central area of the punch, the locating pin configured to be received within the locating hole to provide repeatable orientation of the punch within the collet and die located on the bottom die plate.

18. The punch and die holding apparatus of claim 14, further comprising a clamp-on shaft collar having a circular shape, and having an outer diameter defining an outer surface, an inner diameter defining an inner surface, a first thickness defined between the outer and inner diameter, a first end, a second end, a second thickness defined between the first end and second end, the inner surface being threaded, a hole through the first thickness in a direction tangential to the inner diameter, and configured to receive a shaft collar bolt through the hole, wherein turning the shaft collar bolt decreases the inner diameter of the shaft collar.

19. The punch and die holding apparatus of claim 14, wherein the collet inner bore defines a polygonal bore.

20. The punch and die holding apparatus of claim 14, further comprising a punch spring attached to the punch central portion and extending from the punch central portion and surrounding the punch protrusion.

21. The punch and die holding apparatus of claim 14, further comprising a punch spring having a first end attached to the central portion, a second end, a central body between the first end and second end and surrounding the punch protrusion, and a metal disc attached to the punch spring second end.

22. A punch and die holding apparatus comprising:

a die block including a main body having a bottom die plate defining a die recess and forming a die clamp, a top die plate defining a guide tube cavity, the bottom die plate and top die plate defining a punch receiving gap, a die plate clamping bolt engaged with the bottom die plate and top die plate, and a plurality of gap opening stops engaged with the bottom die plate and top die plate;

a punch holder, at least partially disposed within the guide tube cavity, having a guide tube forming a first cylinder having a first end, a second end, and a wall extending between the first end and second end, a collet chuck at least partially inserted within the guide tube, the collet chuck defining a second cylinder having a first end, a second end, and a wall extending between the first end and second end, and an inner diameter and an outer diameter, a collet inserted within the collet chuck, the collet forming a first end and a second end and an inner diameter and outer diameter, and a punch having a first end comprising a stem, a second end comprising a punch protrusion, and a central portion, the punch stem configured to be inserted into the second end of the collet;

a die received within the die recess; and a clamp-on shaft collar having a circular shape, and having an outer diameter defining an outer surface, an inner diameter defining an inner surface, a first thickness defined between the outer and inner diameter, a first end, a second end, a second thickness defined between the first end and second end, the inner surface being threaded, a hole through the first thickness in a direction tangential to the inner diameter, and configured to receive a shaft collar bolt through the hole, wherein turning the shaft collar bolt decreases the inner diameter of the shaft collar.

23. The punch and die holding apparatus of claim 22, further comprising a punch spring attached to the punch central portion and extending from the punch central portion and surrounding the punch protrusion.

24. The punch and die holding apparatus of claim 22, further comprising a punch spring having a first end attached to the central portion, a second end, a central body between the first end and second end and surrounding the punch protrusion, and a metal disc attached to the punch spring second end.

* * * * *